US007467665B2

(12) United States Patent
Mackenzie

(10) Patent No.: US 7,467,665 B2
(45) Date of Patent: Dec. 23, 2008

(54) AUTONOMOUS CIRCULATION, FILL-UP, AND EQUALIZATION VALVE

(75) Inventor: Gordon Mackenzie, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 299 days.

(21) Appl. No.: 11/268,863

(22) Filed: Nov. 8, 2005

(65) Prior Publication Data

US 2007/0102164 A1 May 10, 2007

(51) Int. Cl.
*E21B 33/12* (2006.01)
*E21B 23/00* (2006.01)

(52) U.S. Cl. ..... 166/387; 166/66.6; 166/334.4

(58) Field of Classification Search ..... 166/387, 166/187, 334.4, 66.6, 66.7; 137/487.5, 624.12; 251/129.11
See application file for complete search history.

(56) References Cited

U.S. PATENT DOCUMENTS 3,306,363 A * 2/1967 McZilkey, Jr. ..... 166/152
3,503,445 A * 3/1970 Cochrum et al. ..... 166/244.1
4,040,485 A * 8/1977 Vann et al. ..... 166/297
4,653,588 A * 3/1987 White ..... 166/374
4,787,446 A * 11/1988 Howell et al. ..... 166/66.6
4,869,324 A * 9/1989 Holder ..... 166/387
4,877,086 A * 10/1989 Zunkel ..... 166/106
5,205,358 A * 4/1993 Mitzlaff ..... 166/187
5,273,112 A 12/1993 Schultz ..... 166/374
5,531,270 A 7/1996 Fletcher et al. ..... 166/53
5,549,165 A * 8/1996 Brooks ..... 166/386
5,896,928 A 4/1999 Coon ..... 166/373
6,286,594 B1 * 9/2001 French ..... 166/151
6,334,486 B1 * 1/2002 Carmody et al. ..... 166/53
6,341,654 B1 * 1/2002 Wilson et al. ..... 166/387
6,343,651 B1 2/2002 Bixenman ..... 166/278
6,435,282 B1 * 8/2002 Robison et al. ..... 166/386
6,474,419 B2 * 11/2002 Maier et al. ..... 166/387
6,494,265 B2 * 12/2002 Wilson et al. ..... 166/332.1
6,513,595 B1 * 2/2003 Freiheit et al. ..... 166/332.4
6,622,794 B2 9/2003 Zisk, Jr. ..... 166/373
6,668,935 B1 * 12/2003 McLoughlin et al. ..... 166/375
6,675,897 B1 * 1/2004 McGarian et al. ..... 166/321
6,691,587 B1 * 2/2004 King ..... 74/89.35
6,786,285 B2 9/2004 Johnson et al. ..... 166/370
6,802,488 B1 * 10/2004 Patterson ..... 251/129.11
6,817,416 B2 * 11/2004 Wilson et al. ..... 166/332.1
6,860,330 B2 * 3/2005 Jackson ..... 166/332.1
2002/0050354 A1 * 5/2002 Schultz et al. ..... 166/250.01
2002/0062963 A1 * 5/2002 Eslinger et al. ..... 166/308
2003/0132006 A1 * 7/2003 Bussear et al. ..... 166/386
2004/0035577 A1 2/2004 Ramakrishnan et al. ..... 166/250.07
2004/0084189 A1 * 5/2004 Hosie et al. ..... 166/386
2004/0149435 A1 8/2004 Henderson ..... 166/250.15
2005/0224235 A1 * 10/2005 Patel ..... 166/386

* cited by examiner

*Primary Examiner*—Jennifer H Gay
*Assistant Examiner*—Cathleen R Hutchins
(74) *Attorney, Agent, or Firm*—Shawn Hunter

(57) ABSTRACT

Systems and methods for operating a circulation valve such that the valve will automatically close without the need for a ball to be dropped or other intervention from the surface. The circulation valve is autonomous and will preferably be actuated from an open to a closed position by a motive force such as a power screw. The valve includes an actuator that causes the valve to close in response to particular conditions, such as the passing of a predetermined amount of time, or wellbore conditions, such as pressure, temperature or position.

11 Claims, 6 Drawing Sheets

AUTONOMOUS CIRCULATION, FILL-UP, AND EQUALIZATION VALVE

BACKGROUND OF THE INVENTION

1. Field of the Invention

The invention relates generally to the design of circulating valves used in wellbores.

2. Description of the Related Art

Circulating valves are used to provide fluid communication between the central flowbore and the annulus. The typical circulating valve has a sliding sleeve that is movable to selectively cover several ports that allow fluid flow between the annulus and the flowbore. These valves are important during an operation to run a device into a wellbore. They allow fluid to be circulated into the flowbore from the annulus (fill up), or from the flowbore out into the annulus (circulation). They also ensure that pressure is equalized between the flowbore and the annulus. A typical application for a circulating valve would be running in and setting an inflatable packer on coiled tubing. The circulating valve would be open during the run in. When the packer reaches the depth at which it will be set, the circulating valve must be closed in order to set the packer. In conventional designs, surface intervention is necessary to close the valve. Normally, this is accomplished by dropping a closing ball into the flowbore. The ball lands on a ball seat within the valve. Fluid pressure is increased behind the ball, and the sleeve is then shifted closed. On many occasions, including the setting of an inflatable packer, it is undesirable to drop a closing ball to close the sleeve. The operation can be time consuming and detrimental to the operation of tools below the ball. Thus, it is desired to have an alternative method of selectively closing the circulation valve.

The present invention addresses the problems of the prior art.

SUMMARY OF THE INVENTION

The invention provides systems and methods for operating a circulation valve such that the valve will automatically close without the need for a ball to be dropped or other intervention from the surface. The circulation valve is autonomous and will preferably be actuated from an open to a closed position by a power screw or another suitable motive force mechanism. In one embodiment, the valve is actuated by a timer such that it will close after a predetermined period of time has passed. In further embodiments, the valve is associated with a sensor to detect certain wellbore conditions, such as flow, pressure or temperature or a combination of conditions. When a predetermined condition or set of conditions is detected, the valve closes. In accordance with still further embodiments, an accelerometer or position sensor is associated with the circulating valve to determine when the packer or other tool has reached its desired depth. At that time, the valve is closed.

DETAILED DESCRIPTION OF THE PREFERRED EMBODIMENTS

Figure 1:
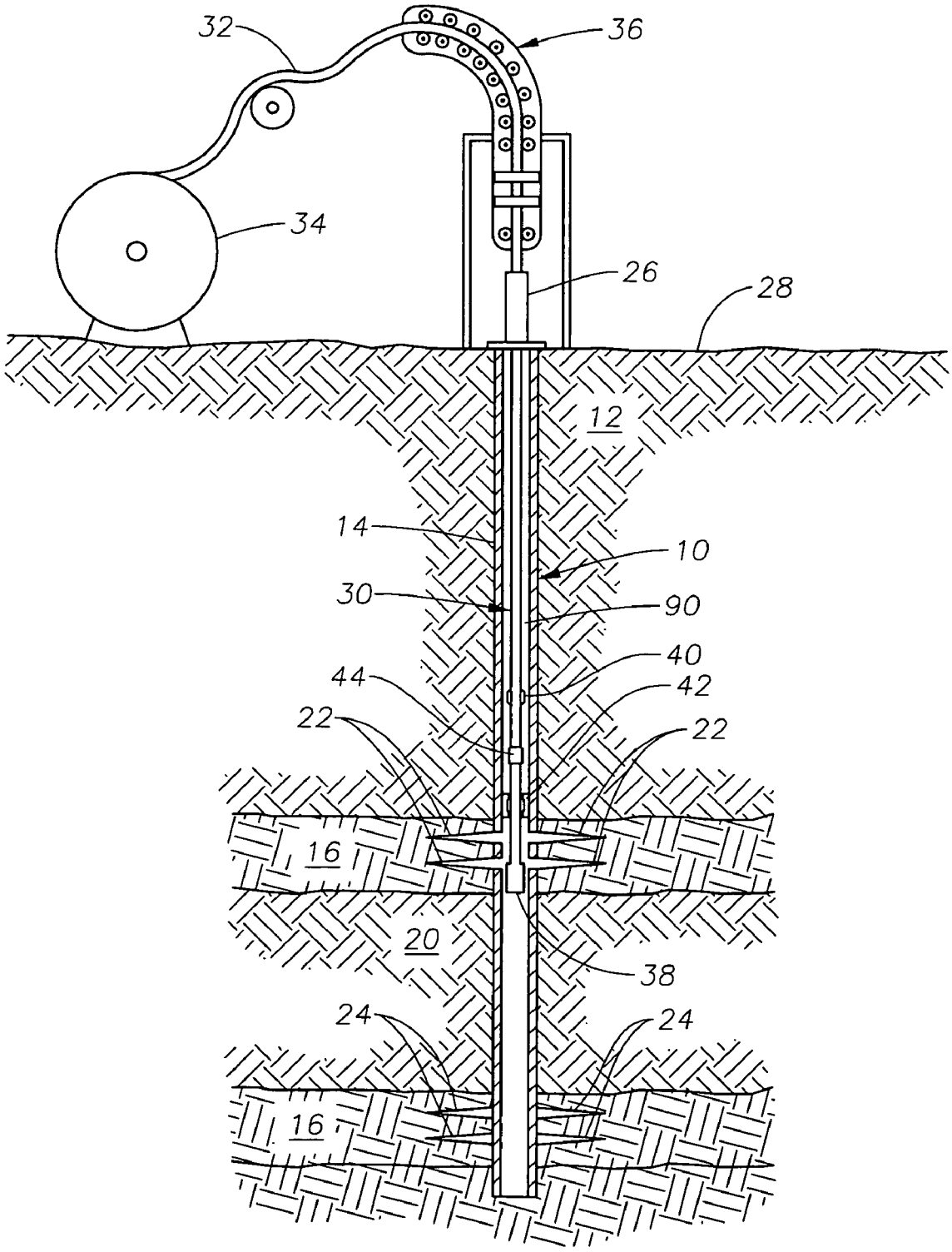
FIG. 1 is a side, cross-sectional view of a running arrangement wherein an inflatable bridge plug is being run into a wellbore on coiled tubing having a circulation valve constructed in accordance with the present invention.
Figure 2:
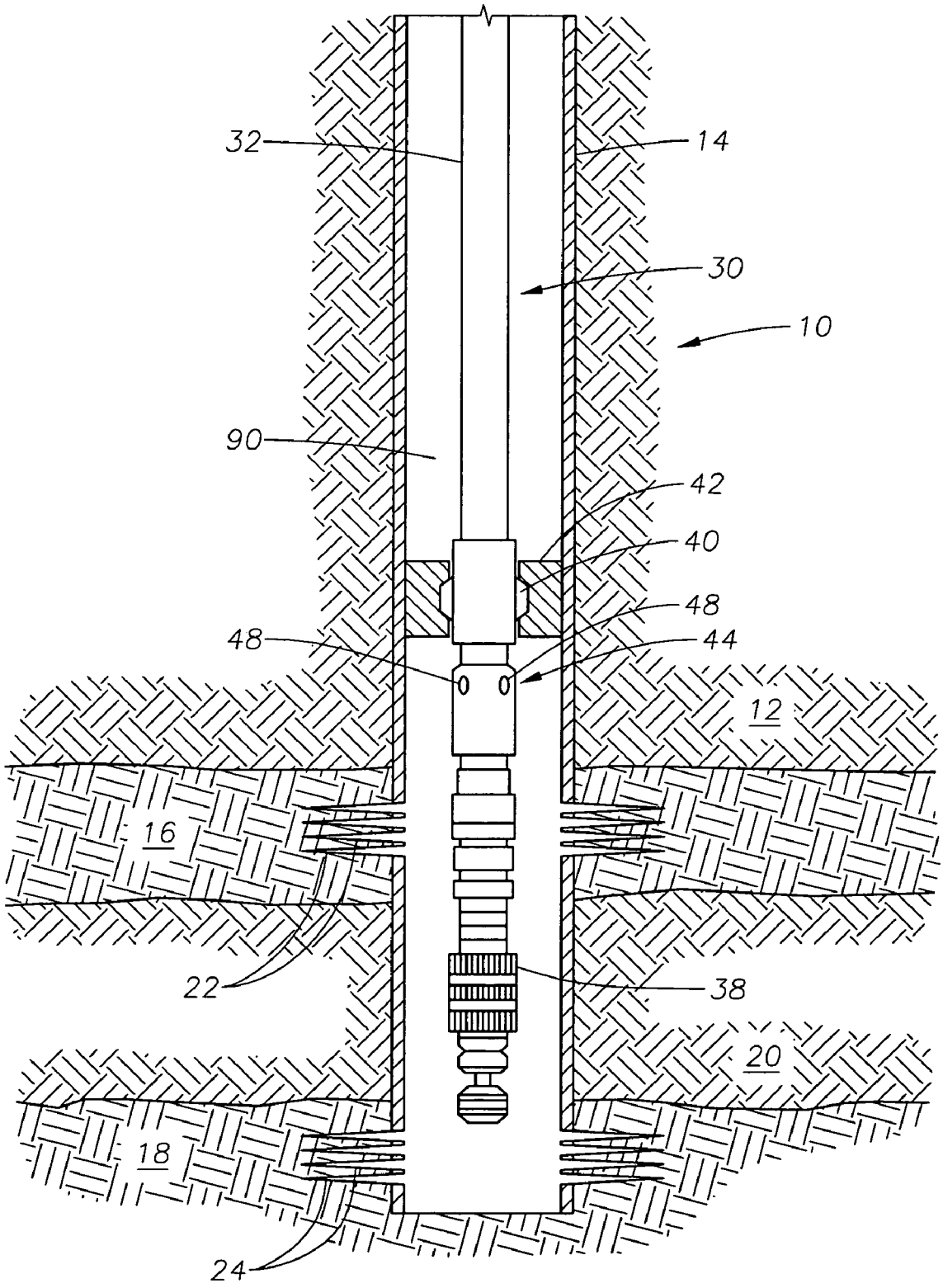
FIG. 2 is a closer side, cross-sectional view of the arrangement shown in FIG. 1 now with the circulation valve having been closed in preparation to set the bridge plug.

FIGS. 1 and 2 illustrate an exemplary slim hole-style wellbore 10 that has been drilled through the earth 12. The wellbore 10 has been lined with steel casing 14. Two separate hydrocarbon-bearing formation layers 16, 18 are present in the earth 12 and separated by an interval 20 of relatively impermeable rock. Perforations 22, 24 have been previously created through the casing 14 and into layers 16 and 18, respectively, to allow fluid communication from the formations 16, 18 into the wellbore 10. In this illustration, it is desired to run in and set an inflatable bridge plug packer device within the wellbore 10 between the upper perforations 22 and the lower perforations 18. This might be done because, for example, the lower formation 18 has suffered from water infiltration or the like so that it is no longer desirable to produce from the lower formation 18.

A wellhead 26 is located at the surface 28. An exemplary coiled tubing running arrangement, generally indicated at 30, is shown being run into the wellbore 10 through the wellhead 26. Coiled tubing 32 is dispensed from spool 34 and injected into the wellhead 26 by a coiled tubing injector apparatus 36 of a type known in the art. Those of skill in the art will understand that while coiled tubing 32 is a continuous string of tubing, the coiled tubing running arrangement 30 will actually contain a number of connectors and tools incorporated into it, but will define a central flowbore along its length. The lower end of the coiled tubing running arrangement 30 carries an inflatable bridge plug 38. Also included in the coiled tubing running arrangement 30 is a nipple profile locator 40 that is designed to locate and latch into landing nipple 42 in the casing 14. The coiled tubing running arrangement 30 also includes an autonomous circulating valve 44, which is constructed in accordance with the present invention. The structure and function of the circulation valve 44 will be described in greater detail shortly. It is noted that the details of surface valving and fluid pressurization of the coiled tubing are not shown in FIG. 1 or described in detail herein, as such details are well understood by those of skill in the art.

Figure 3:
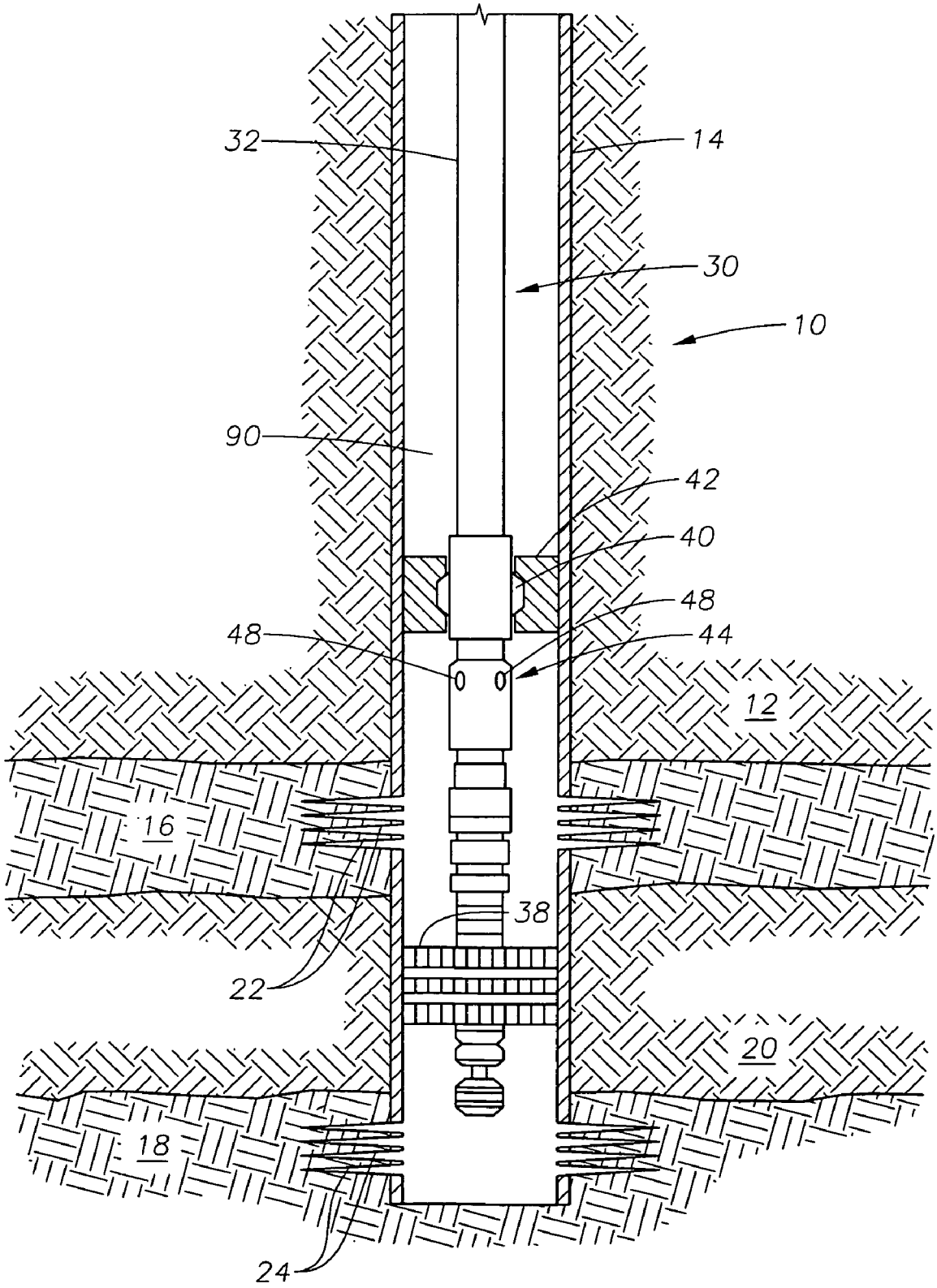
FIG. 3 is a side, cross-sectional view of the arrangement shown in FIGS. 1 and 2 now with the bridge plug having been set.

FIGS. 2 and 3 illustrate the components associated with the downhole portions of the coiled tubing running arrangement 30 in greater detail. In FIG. 2, the nipple profile locator 40 has been landed into landing nipple 42. The circulation valve 44, which can be seen to have lateral fluid ports 48, is moved from its open configuration to a closed position. The bridge plug 38 is in an unset position, but is aligned with the impermeable layer 20 and between perforations 22 above and perforations 24 below. In FIG. 3, the bridge plug 38 has been inflated by increased fluid pressure within the coiled tubing 32. When set, the bridge plug 38 forms a fluid seal between the production zones 16 and 18.

Figure 4:
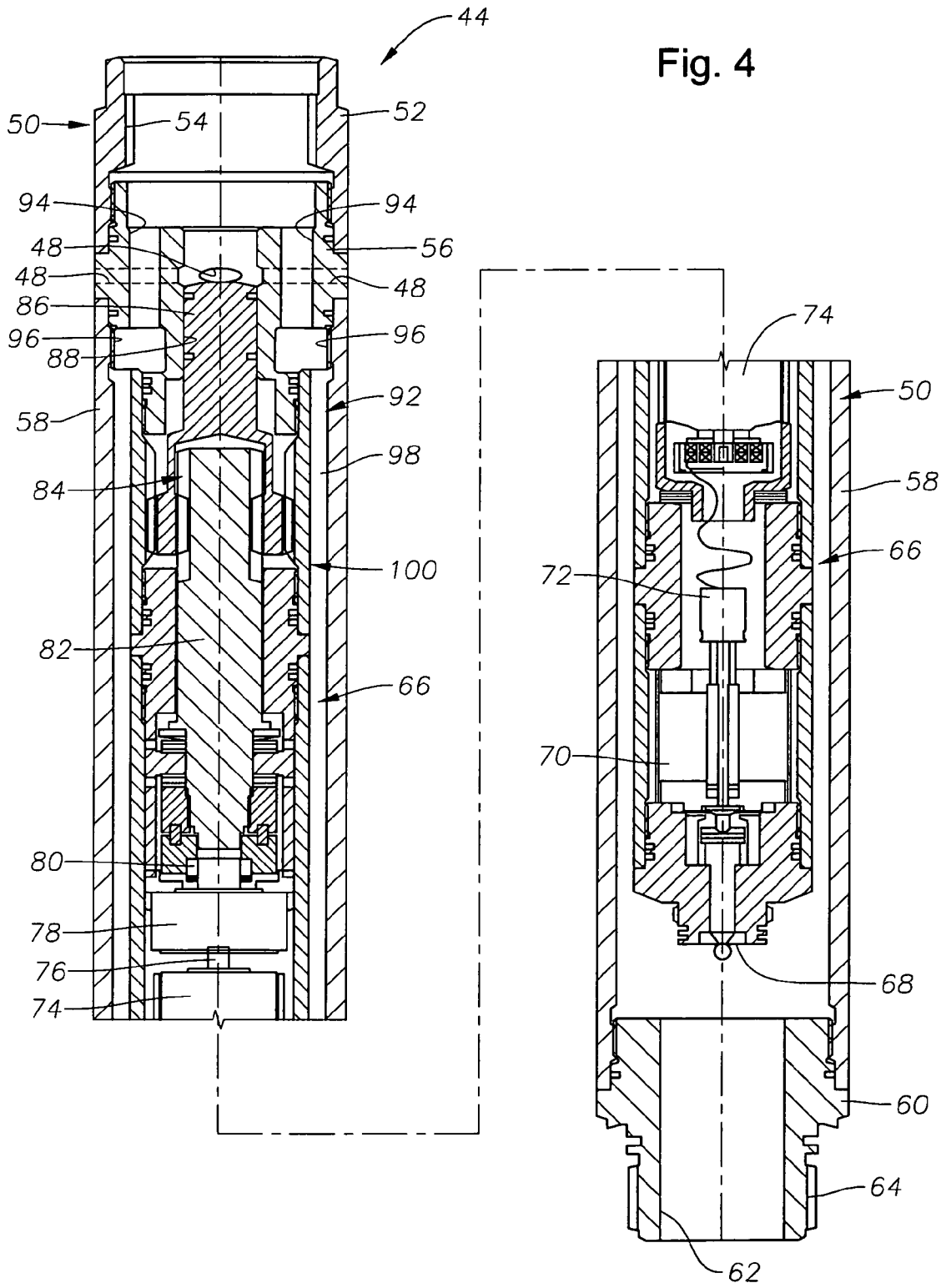
FIG. 4 is a one-quarter cross-sectional view of an exemplary circulation valve constructed in accordance with the present invention and in an open, circulating configuration.
Figure 5:
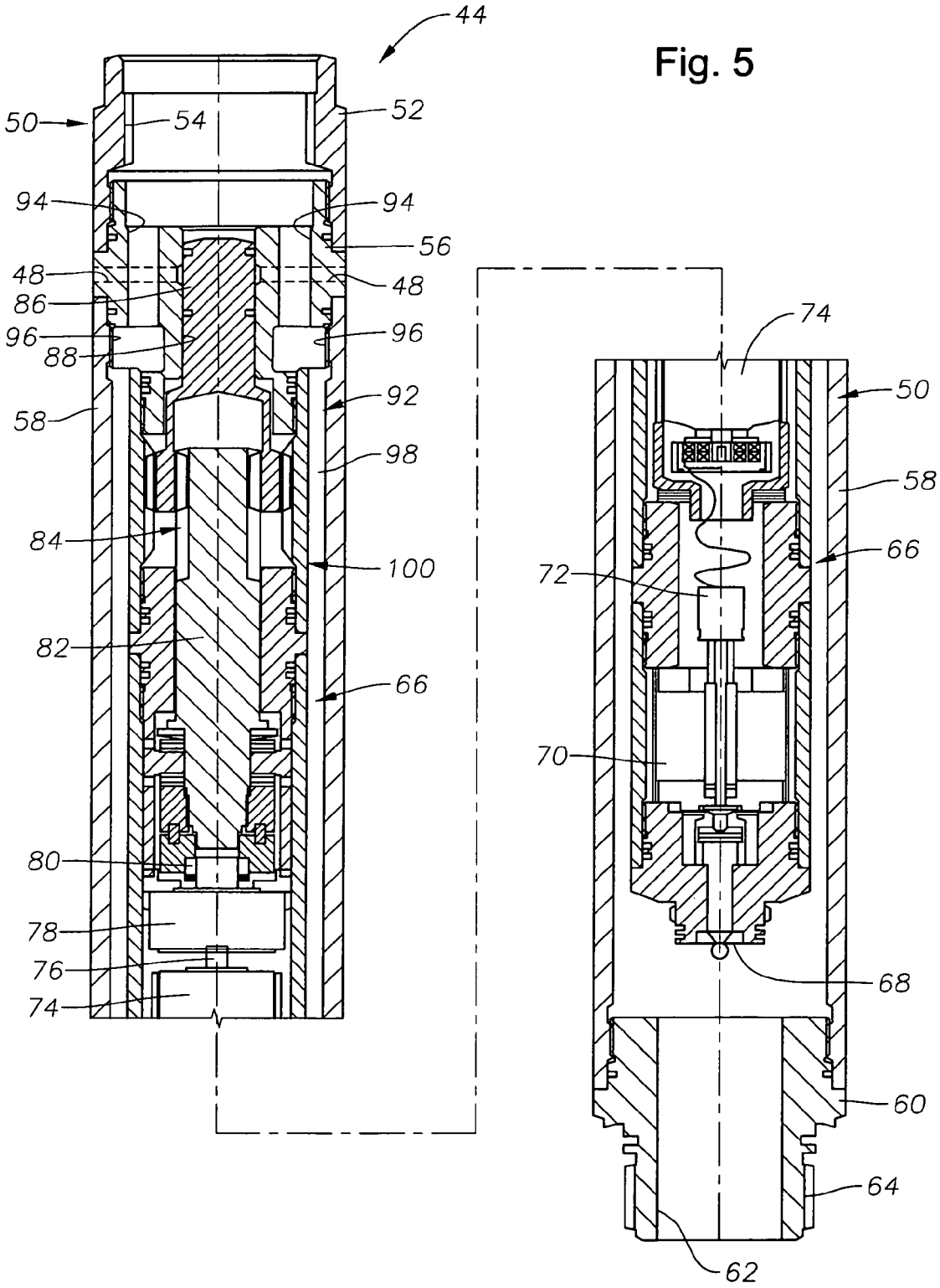
FIG. 5 is a one-quarter cross-sectional view of the circulation valve shown in FIG. 4, now in a closed configuration.

FIGS. 4 and 5 depict details of the autonomous circulating valve 44 that is constructed and operates in accordance with the present invention. The valve 44 includes a valve body 50 having an upper sub 52 with a box-type threaded portion 54 for interconnection to coiled tubing or other components in the coiled tubing running arrangement 30. The upper sub 52 is threadedly connected to a circulation sub 56. An outer housing 58 is secured to the lower end of the circulation sub 56. A lower sub 60 is secured to the lower end of the outer housing 58. The lower sub 60 has a defined axial flowbore 62 that passes centrally through and a pin-type threaded connection 64.

The outer housing 58 encloses a power screw assembly, designated generally as 66. Beginning from the lower end, the power screw assembly 66 includes a battery housing connection 68 for interconnection of a battery (not shown) or other power source and an electronics housing 70. A power lead 72 extends from the electronics housing 70 to a rotary motor 74. In a currently preferred embodiment, the motor 74 is a brushless motor, but may, in fact, be any type of suitable motor. Rotary shaft 76 from motor 74 is interconnected to transmission 78, and a transmission drive gear 80 is interconnected to power screw drive member 82 for rotation thereof under impetus of the motor 74. A helical, or screw-type, interface 84 is provided between the drive member 82 and a valve stem 86. The helical interface 84 causes rotation of the drive member 82 to be converted into axial movement of the valve stem 86 within a valve stem passage 88 defined within the circulation sub 56.

A number of fluid flowpaths are defined within the valve 44. The circulation sub 56 contains lateral fluid passages 48 that allow fluid communication between the valve stem passage 88 and the annulus 90 surrounding the valve 44. In addition, there is an axial flow pathway 92 that allows fluid to pass axially through the valve 44 when the valve 44 is in the open configuration shown in FIG. 4. In the embodiment depicted, the axial pathway 92 includes flow passages 94, which are drilled axially through the circulation sub 56, an annular chamber 96, and an annular flow space 98. The annular flow space 98 is defined between the outer housing 58 and an inner housing 100 that protects portions of the power screw mechanism described previously. These flowpaths allow fluid to flow during operation as necessary for equalization and circulation. During run-in of the coiled tubing running arrangement 30, with the valve 44 in the open position shown in FIG. 4, fluid tends to circulate through the lateral flow passages 48, as this presents the path of least resistance.

Figure 6:
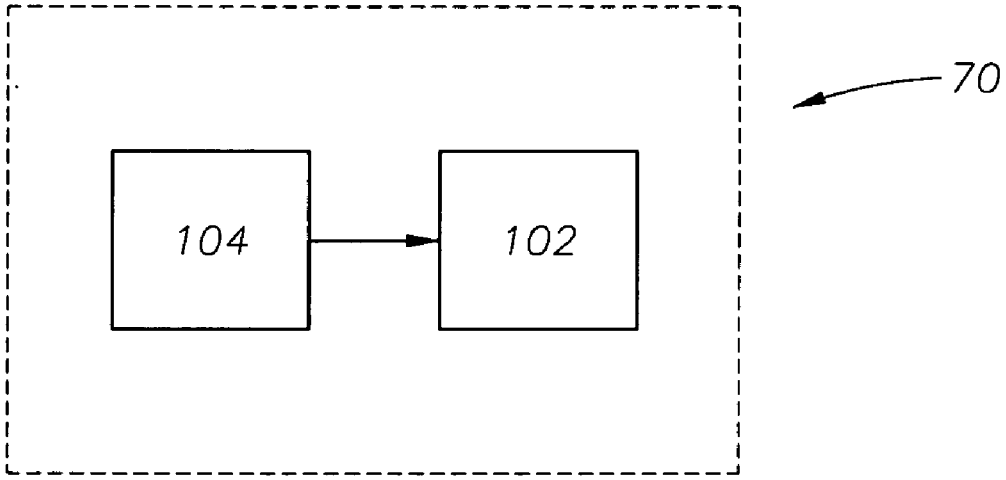
FIG. 6 illustrates one embodiment for a control module used with the circulation valve of FIGS. 4 and 5.

Referring now to FIG. 6, the electronics housing 70 is schematically shown to enclose a motor driver 102 and an autonomous actuator, or control module, 104 that actuates the motor driver 102 upon a predetermined condition or set of conditions being reached. In this embodiment, the actuator 104 comprises a timer that can be preset to provide a predetermined delay before the motor driver 102 is actuated by the actuator 104. In operation, the actuator 104 is preset at the surface 28 before the running string 30 is run into the wellbore 10 to provide a predetermined time delay (8 hours, for example). The running string 30 is then run into the wellbore 10 with the circulating valve 44 in the open configuration so that fluid can be circulated through the ports 64, 48 of the valve 44 during run-in. The nipple profile locator 40 lands upon landing nipple 42 to position the bridge plug 38 at its desired setting depth. After the predetermined amount of time has elapsed, the timer 104 will actuate the motor driver 102 to energize the motor 74. When the motor 74 is energized, it will cause the transmission 78 to rotate the drive member 82 of the power screw assembly 66. As a result of the rotation of the drive member 82, the valve stem 86 is moved axially upwardly to the closed position shown in FIG. 5 wherein the valve stem 86 blocks the lateral flow ports 48. With the lateral flow ports 48 now closed, fluid flowed down through the coiled tubing 32 is forced to pass through the axial flow pathway 92 of the valve 44. When the valve 44 is closed in this manner fluid pressure within the coiled tubing 32 can be used to set the bridge plug 38, in a manner known in the art.

Figure 7:
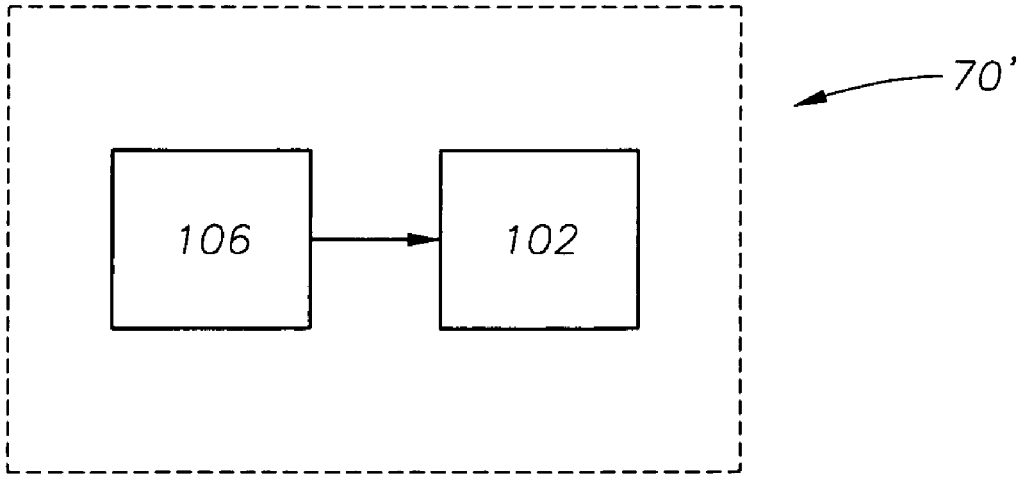
FIG. 7 illustrates an alternative embodiment for a control module used with the circulation valve of FIGS. 4 and 5.

The valve 44 might, alternatively, utilize an electronics module 70' (shown in FIG. 7, that is constructed according to alternative embodiments in order to cause the valve 44 to operate autonomously. FIG. 7 depicts, in schematic fashion, an electronics module 70' which includes a sensor 106 that is of a type known in the art for detecting a particular wellbore condition, such as temperature or pressure. In operation, the electronics module 70' would cause the valve 44 to close upon the detection of a particular wellbore condition (pressure or temperature) that would occur when the sensor has reached a particular depth or location within the wellbore 10 (i.e., the setting depth).

Alternatively, the sensor 106 might comprises an accelerometer or position sensor. In such an instance, the sensor 106 might cause the valve 44 to close when the accelerometer or position sensor detects that the running string 30 has been landed into the landing nipple 42, thus indicating that setting depth has been reached. It is noted, that, while the invention has been described with respect to the running in and setting of a bridge plug packer device 58, the methods and devices described herein may as well be used for the running in and actuation of other hydraulically-actuated tools.

Those of skill in the art will recognize that numerous modifications and changes may be made to the exemplary designs and embodiments described herein and that the invention is limited only by the claims that follow and any equivalents thereof.

What is claimed is:

1. A method of running in and actuating a hydraulically-actuated tool within a wellbore, the method comprising the steps of:

assembling a running string having a hydraulically-actuated tool, and an autonomous circulating valve having open and closed positions;

running the running string into the wellbore with the circulating valve in its open position;

allowing the circulating valve to move from its open position to its closed position autonomously; and actuating the hydraulically-actuated tool.

2. The method of claim 1 wherein the step of actuating the hydraulically-actuated tool further comprises setting an inflatable bridge plug.

3. The method of claim 1 wherein the step of allowing the circulating valve to move to its closed position further comprises energizing a power screw after the passing of a predetermined amount of time.

4. The method of claim 1 wherein the step of allowing the circulating valve to move to its closed position further comprises energizing a power screw upon detection of a certain wellbore condition.

5. A method of running in and actuating a hydraulically-actuated tool within a wellbore, the method comprising the steps of:

assembling a running string having a hydraulically-actuated bridge plug, and an autonomous circulating valve having open and closed positions;

running the running string into the wellbore with the circulating valve in its open position;

allowing the circulating valve to move from its open position to its closed position autonomously; and actuating the hydraulically-actuated bridge plug.

6. The method of claim 5 wherein the step of allowing the circulating valve to move to its closed position further comprises energizing a power screw after the passing of a predetermined amount of time.

7. The method of claim 5 wherein the step of allowing the circulating valve to move to its closed position further comprises energizing a power screw upon detection of a certain wellbore condition.

8. The method of claim 5 wherein the step of actuating the hydraulically-actuated bridge plug further comprises inflating the bridge plug.

9. A method of running in and actuating a hydraulically-actuated tool within a wellbore, the method comprising the steps of:

assembling a running string having a hydraulically-actuated inflatable bridge plug, and an autonomous circulating valve having open and closed positions;

running the running string into the wellbore with the circulating valve in its open position;

allowing the circulating valve to move from its open position to its closed position autonomously; and actuating the hydraulically-actuated inflatable bridge plug.

10. The method of claim 9 wherein the step of allowing the circulating valve to move to its closed position further comprises energizing a power screw after the passing of a predetermined amount of time.

11. The method of claim 9 wherein the step of allowing the circulating valve to move to its closed position further comprises energizing a power screw upon detection of a certain wellbore condition.

* * * * *